US005777301A

United States Patent [19]

Kim

[11] Patent Number: 5,777,301

[45] Date of Patent: Jul. 7, 1998

[54] RELAY DRIVING APPARATUS FOR MICROWAVE OVEN AND METHOD THEREOF

[75] Inventor: Tae Woo Kim, Kyungsangnam-Do, Rep. of Korea

[73] Assignee: LG Electronics Inc., Rep. of Korea

[21] Appl. No.: 580,299

[22] Filed: Dec. 28, 1995

[51] Int. Cl.[6] ..... H05B 6/68

[52] U.S. Cl. ..... 219/721; 219/716; 219/722; 363/49

[58] Field of Search ..... 219/721, 715, 219/716, 702, 722, 723; 363/49

[56] References Cited

U.S. PATENT DOCUMENTS

| | | | |
|---|---|---|---|
| 4,719,326 | 1/1988 | Yoo | 219/721 |
| 4,720,762 | 1/1988 | Estes | 361/154 |
| 4,787,008 | 11/1988 | Graff et al. | 361/190 |
| 4,967,051 | 10/1990 | Maehara et al. | 219/721 |
| 5,286,938 | 2/1994 | Takei et al. | 219/715 |
| 5,317,115 | 5/1994 | Forsberg | 219/716 |
| 5,357,087 | 10/1994 | Choi | 219/721 |
| 5,595,674 | 1/1997 | Kim | 219/715 |

FOREIGN PATENT DOCUMENTS

| | | |
|---|---|---|
| 789636 | 2/1973 | Belgium . |
| 551586 | 7/1993 | European Pat. Off. . |
| 2943062 | 5/1980 | Germany . |

OTHER PUBLICATIONS

*Patent Abstracts Of Japan*, vol. 0 17, No. 579 (E-1451) 21 Oct. 1993; JP-A-05 174964, Jul. 13, 1993.

*Primary Examiner*—Philip H. Leung

*Attorney, Agent, or Firm*—Ostrolenk, Faber, Gerb & Soffen, LLP

[57] ABSTRACT

In a relay driving apparatus and method for a microwave oven, a high relay driving voltage is applied at an initial relay driving time to reduce the operating time deviation between relay parts and the high relay driving voltage is lowered to a normal relay driving voltage through a damp resistance if contact points of a relay switch are coupled, thereby implementing a fix crossing. Therefore, rush current is minimized during relay operation, thereby preventing the fixation of the contact points of a relay switch and the generation of noises due to vibration.

4 Claims, 6 Drawing Sheets

FIG. 1
CONVENTIONAL ART
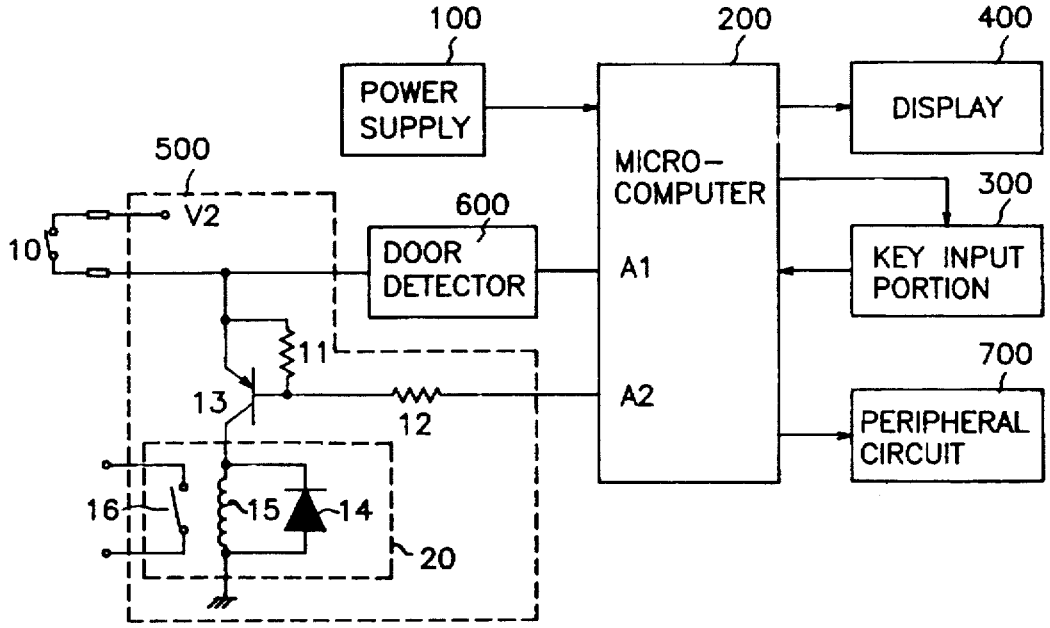
FIG. 2A
CONVENTIONAL ART
FIG. 2B
CONVENTIONAL ART
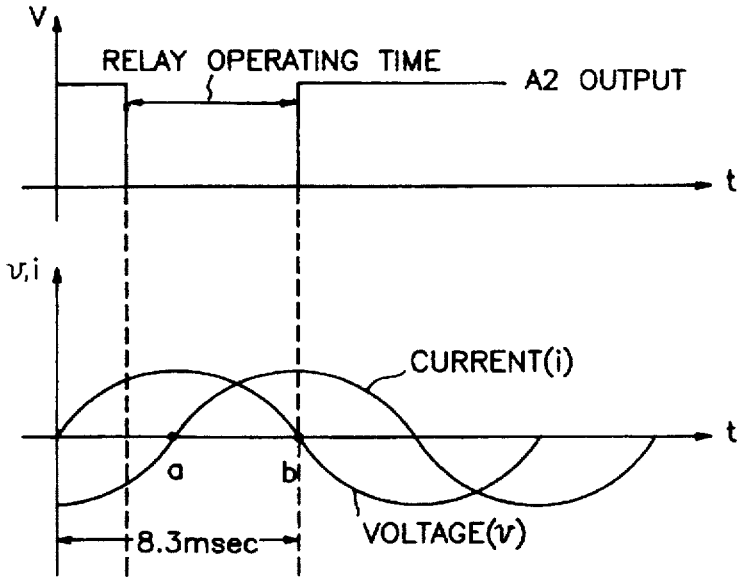

FIG. 4A
FIG. 4B
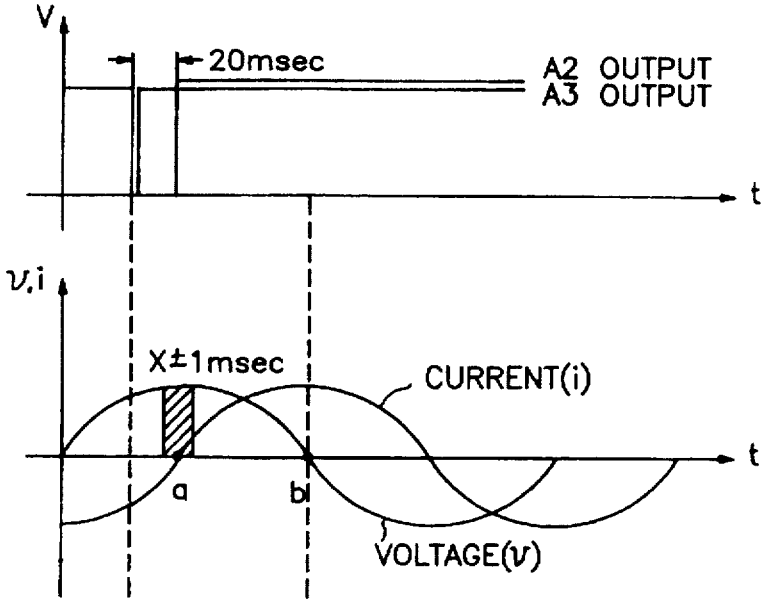
FIG. 5
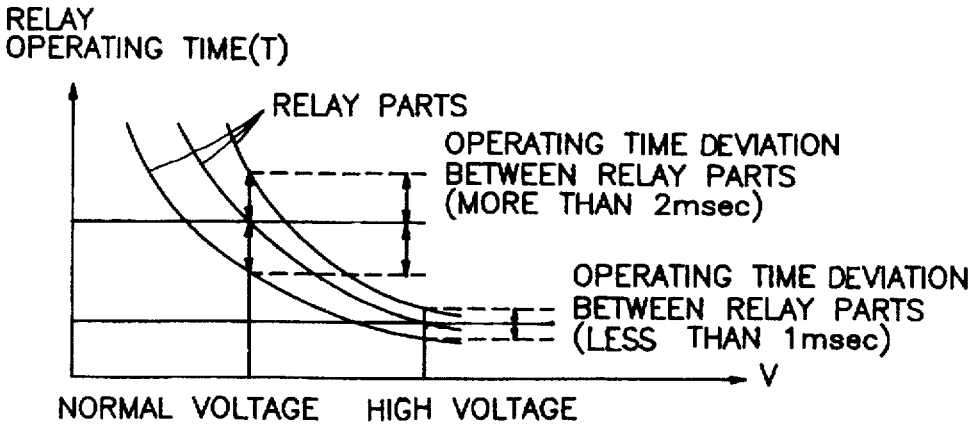

RELAY DRIVING APPARATUS FOR MICROWAVE OVEN AND METHOD THEREOF

BACKGROUND OF THE INVENTION

The present invention relates to a relay driving of a microwave oven, and more particularly, to a relay driving apparatus and method for a microwave oven which can prevent the generation of rush current during relay operation, by implementing a fix crossing by minimizing the operating time deviation between relay parts.

As shown in FIG. 1, the relay driving circuit for a conventional microwave oven includes a power supply 100 for supplying power to a system, a microcomputer 200 for receiving the power from power supply 100 and executing an overall control operation of the system, a key input portion 300 for selecting a function of the microwave oven through a user's key manipulation, a display 400 for displaying the selected function and the operation state of microcomputer 200 depending on the selected function, a relay driver 500 for driving a magnetron and a heater in accordance with a control signal of microcomputer 200, a door detector 600 for detecting a door state and outputting the detection result to microcomputer 200 and a peripheral circuit 700 having a buzzer circuit for generating a buzzing sound in accordance with a control signal of microcomputer 200 and an oscillator for supplying a clock signal to microcomputer 200.

Relay driver 500 is constituted by a PNP transistor 13 whose base is connected to an output port A2 of microcomputer 200 via resistance 12, whose emitter is connected to a power supply port V2 via door detector 600 and a door switch 10 and is connected to base via a bias resistance 11, for being operated in accordance with the control signal output from microcomputer 200, and a relay 20 whose first side is grounded and whose second side is connected to collector of PNP transistor 13, for being driven in accordance with the operation state of PNP transistor 13.

Relay 20 having a relay coil 15 with reverse voltage preventive diodes 14 connected in parallel and a relay switch 16 driven by relay coil 15 switches AC power applied to a magnetron.

The operation of the relay driver having the aforementioned configuration will now be described with reference to accompanying drawings.

First, as shown in FIG. 1, in a state where door switch 10 is shut, if a user selects a predetermined cooking function of a microwave oven through key input portion 300, microcomputer 200 recognizes the selection to display the information corresponding to the selected cooking function to display 400 and outputs a control signal of a low level to the output port A2 for a cooking function set time to turn PNP transistor 13 on.

Thus, the voltage input to power supply port V2 flows toward relay 20 via door switch 10 and PNP transistor 13 so that a voltage V2 is applied to relay coil 15.

Contact points of relay switch 16 are coupled by the voltage V2 so that AC power flows, thereby oscillating the magnetron to perform the selected cooking function.

Thereafter, if a completion time of the set cooking function has been reached, microcomputer 200 outputs a control signal of a high level through the output port A2 to turn PNP transistor 13 off, thereby stopping the operation of relay 20 and the oscillation the of magnetron to terminate the cooking function.

However, if PNP transistor 13 is turned on by the control signal output from microcomputer 200, as shown in FIG. 2A, contact points of relay switch 16 are coupled by the voltage V2 flowing along relay coil 15 and AC voltage v and current i flow through relay switch 16, as shown in FIG. 2B.

At this time, if the contact points of relay switch 16 are coupled at a point a, the voltage v flowing therethrough becomes maximum and the current i (rush current) becomes minimum. If the contact points of relay switch 16 are coupled at a point b by the deviation of relay operating time, the voltage v becomes minimum and the current i (rush current) becomes maximum.

If the rush current is maximum, the contact points of the relay switch 16 stick together by the rush current. Also, during the relay operation, the vibration due to the rush current results in noises.

SUMMARY OF THE INVENTION

Therefore, it is an object of the present invention to provide a relay driving circuit and method for a microwave oven which can minimize the operating time deviation between relay parts by applying a high relay driving voltage at an initial relay driving time and can prevent the generation of rush current by lowering the voltage through a damper resistance to a normal relay driving voltage.

To accomplish the above objects, there is provided a relay driving circuit for a microwave oven having a power supply for supplying power to the system, a microprocessor for receiving the power from the power supply to execute an overall controlling operation of the system, a door detector for detecting a door state, a key input portion for selecting a function of the microwave oven through a user's key manipulation and a display for displaying the selected function and the operation state of the microcomputer in accordance with the function, the circuit comprising: a relay driving portion for reducing the operating time deviation between relay parts by applying a high relay driving voltage for a predetermined time at an initial relay driving time in accordance with a control signal of the microcomputer and for lowering the high relay driving voltage to a normal relay driving voltage.

To accomplish the above object, there is also provided a relay driving method for a microwave oven comprising the steps of: connecting contact points of a relay by controlling a PNP transistor and an NPN transistor to apply a high driving voltage to the relay (step 1); controlling the PNP transistor and NPN transistor to damp the high driving voltage applied to the relay if a predetermined time elapses, and maintaining a normal relay driving voltage to execute a cooking function; and controlling the PNP transistor and NPN transistor to turn the relay off if a cooking termination time is reached, to terminate the cooking function.

BRIEF DESCRIPTION OF THE DRAWINGS

The above objects and advantages of the present invention will become more apparent by describing in detail a preferred embodiment thereof with reference to the attached drawings in which:

FIG. I is a schematic diagram of a relay driving circuit for a conventional microwave oven;

FIGS. 2A and 2B; are waveform diagrams of various parts for driving a relay in FIG. 1;

FIGS. 4A and 4B; are waveform diagrams of various parts for driving a relay in FIG. 3;

FIG. 5 illustrates operating time deviation between relay parts at a normal voltage and a high voltage;

DETAILED DESCRIPTION OF THE INVENTION

Figure 3:
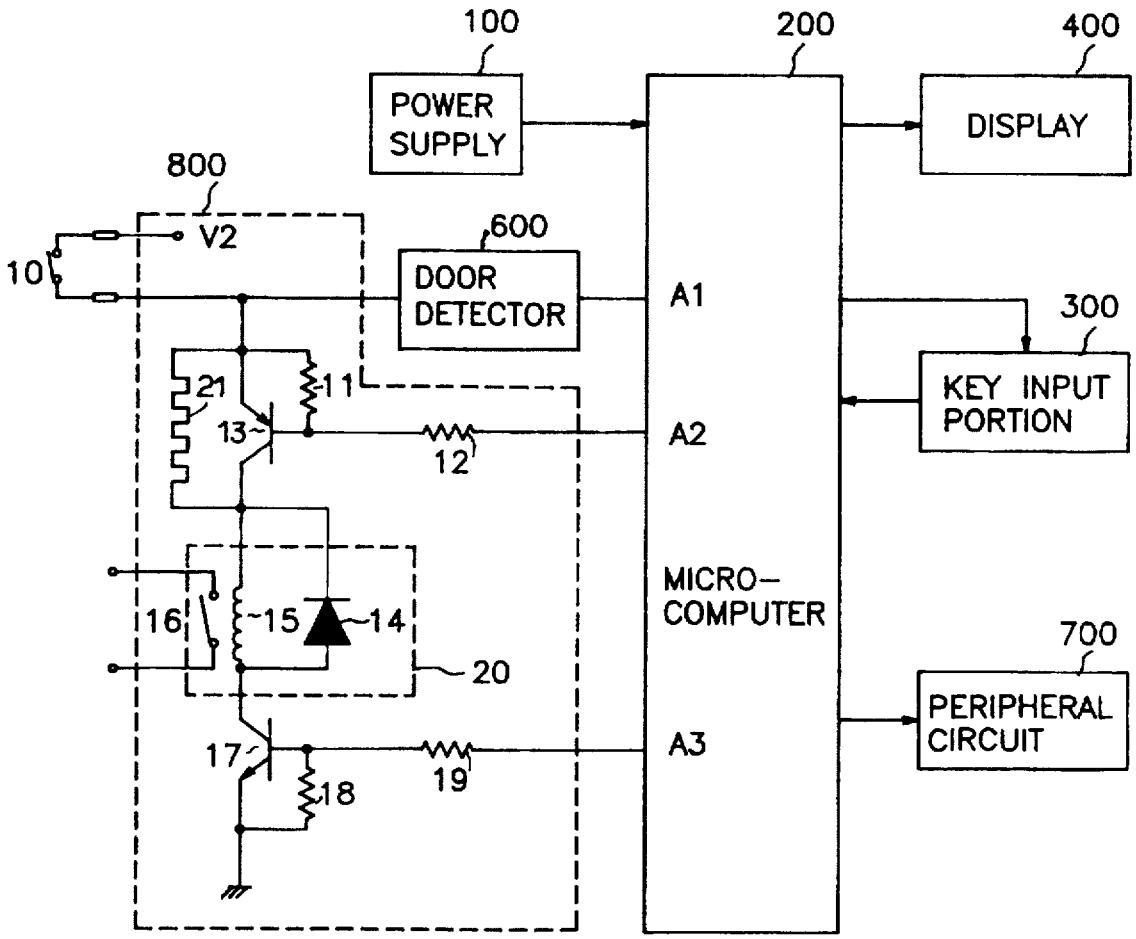
FIG. 3 is a schematic diagram of a relay driving circuit for a microwave oven according to the present invention.
Figure 6:
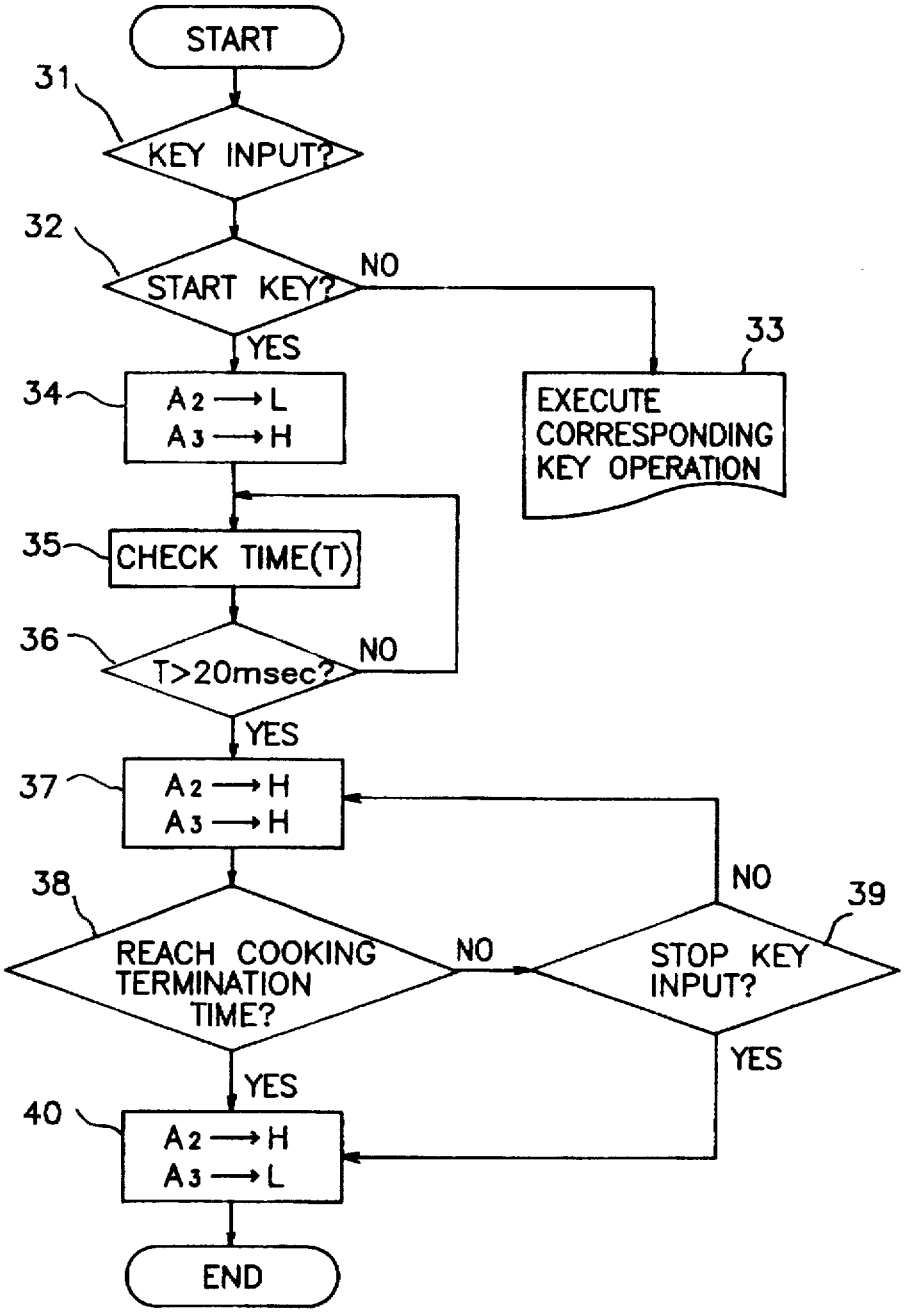
FIG. 6 is a flowchart for driving the relay in FIG. 3.

As shown in FIG. 3, the relay driving circuit for a microwave oven according to the present invention includes a power supply 100 for supplying power to the system, a microprocessor 200 for receiving the power from power supply 100 to execute an overall controlling operation of the system, a key input portion 300 for selecting a function of the microwave oven through a user's key manipulation, a display 400 for displaying the selected function and the operation state of microcomputer 200 in accordance with the function, a door detector 600 for detecting a door state and outputting the detection result to microcomputer 200, a peripheral circuit 700 having a buzzer circuit for generating a buzzing sound in accordance with a control signal of microcomputer 200 and an oscillator for supplying a clock signal to microcomputer 200, and a relay driver 800 being operated by the control of microcomputer 200 for driving a magnetron (not shown) and a heater.

Relay driver 800 is constituted by a PNP transistor 13 whose base is connected to an output port A2 of microcomputer 200 via resistance 12, whose emitter is connected to a power supply port V2 via door detector 600 and a door switch 10 and is connected to base via a bias resistance 11, for being operated in accordance with the control signal output from microcomputer 200, a NPN transistor 17 whose base is connected to an output port A3 of microcomputer 200 via resistance 19, whose emitter is connected to base via ground port and bias resistance 18 for being operated by the control signal output from microcomputer 200, a relay 20 connected to collectors of PNP transistor 13 and NPN transistor 17 for being driven in accordance with the operation state of PNP transistor 13 and NPN transistor 17, and a damper resistance 21 connected to emitter and collector of PNP transistor 13 for lowering a high voltage flowing in relay 20 to a normal voltage.

Relay 20 having a relay coil 15 with reverse voltage preventive diodes 14 connected in parallel and a relay switch 16 driven by relay coil 15 switches AC power applied to magnetron. Here, those parts which are the same as those corresponding parts in the conventional system are designated by the same reference numerals.

The operation of the relay driver for a microwave oven according to the present invention having the aforementioned configuration will now be described with reference to FIGS. 3 through 6.

First, if a user places food in the microwave oven and shuts the door, the contact points of a door switch 10 are coupled so that a high voltage output from power supply source V2 flows through door switch 10, which is detected by door detector 600 and is output to an input port Al of microcomputer 200.

Thereafter, if the user selects a predetermined cooking function of the microwave oven through key input portion 300, as shown in FIG. 3, microcomputer 200 recognizes the user's selection, displays the information corresponding to the selected function to display 400 and outputs a control signal via output ports A2 and A3 to control relay driver 500, which allows the magnetron to be oscillated to execute the cooking function.

In other words, if the user selects a predetermined cooking function through key input portion 300 and manipulates keys, microcomputer 200 recognizes a key input and determines whether or not the input key is a start key (steps 31 and 32).

At this time, if the input key is not a start key, the operation corresponding to the key (step 33). If the input key is a start key, a control signal of a low level is output to PNP transistor 13 via output port A2, a control signal of a high level is output to NPN transistor 17 via output port A3, as shown in FIG. 4A, and then time is counted (steps 34 and 35).

Subsequently, PNP transistor 13 and NPN transistor 17 are both turned on so that the voltage input to power supply port V2 flows toward relay 20 via PNP transistor 13 and then the high voltage V2 is applied to relay coil 15. (At this time, the high voltage V2 ranges from 15V to 20V.)

Therefore, the contact points of relay switch 16 are coupled by the high voltage V2 flowing along relay coil 15 and AC power flows through relay switch 16, thereby oscillating the magnetron to execute the selected predetermined cooking function.

At this time, the operating time deviation between relay parts is greater than 2 milliseconds (msec) if a normal relay driving voltage, e.g., 12V, is applied to relay coil 15, and is less than 1 msec if a high relay driving voltage is applied thereto, as shown in FIG. 5.

Therefore, when the high relay driving voltage V2 flows along relay coil 15, the operating time deviation between relay parts falls within X±1 msec, as shown in FIG. 4B. Thus, when the contact points of relay switch 16 are coupled, the rush current flowing through relay switch 16 becomes minimum.

Thereafter, microcomputer 200 counts the time. If more than 20 msec elapses, the control signal of a high level is output to output ports A2 and A3 to turn PNP transistor 13 off but turns NPN transistor 17 on.

Therefore, the high relay driving voltage (15V~20V) applied to relay coil 15 is lowered by a damper resistance 21 connected between emitter and collector of PNP transistor 13 to maintain a normal relay driving voltage 12V so that the contact points of relay switch 16 are kept to be coupled, thereby proceeding the cooking function for a predetermined time.

Then, microcomputer 200 checks whether the cooking termination time is reached (step 38). If not reached, it is checked whether there is an input of a stop key or not (step 39). If there is no input of a stop key, step 37 is repeatedly performed to continuously executing the cooking function.

On the other hand, if the cooking termination time is reached or there is an input of a stop key, the control signal of a high or low level is output via output port A2 or A3, respectively to turn PNP transistor 13 and NPN transistor 17 off, thereby turning relay switch 16 off and stopping the oscillation of the magnetron to finally terminate the cooking function (steps 39 and 40).

Figure 7:
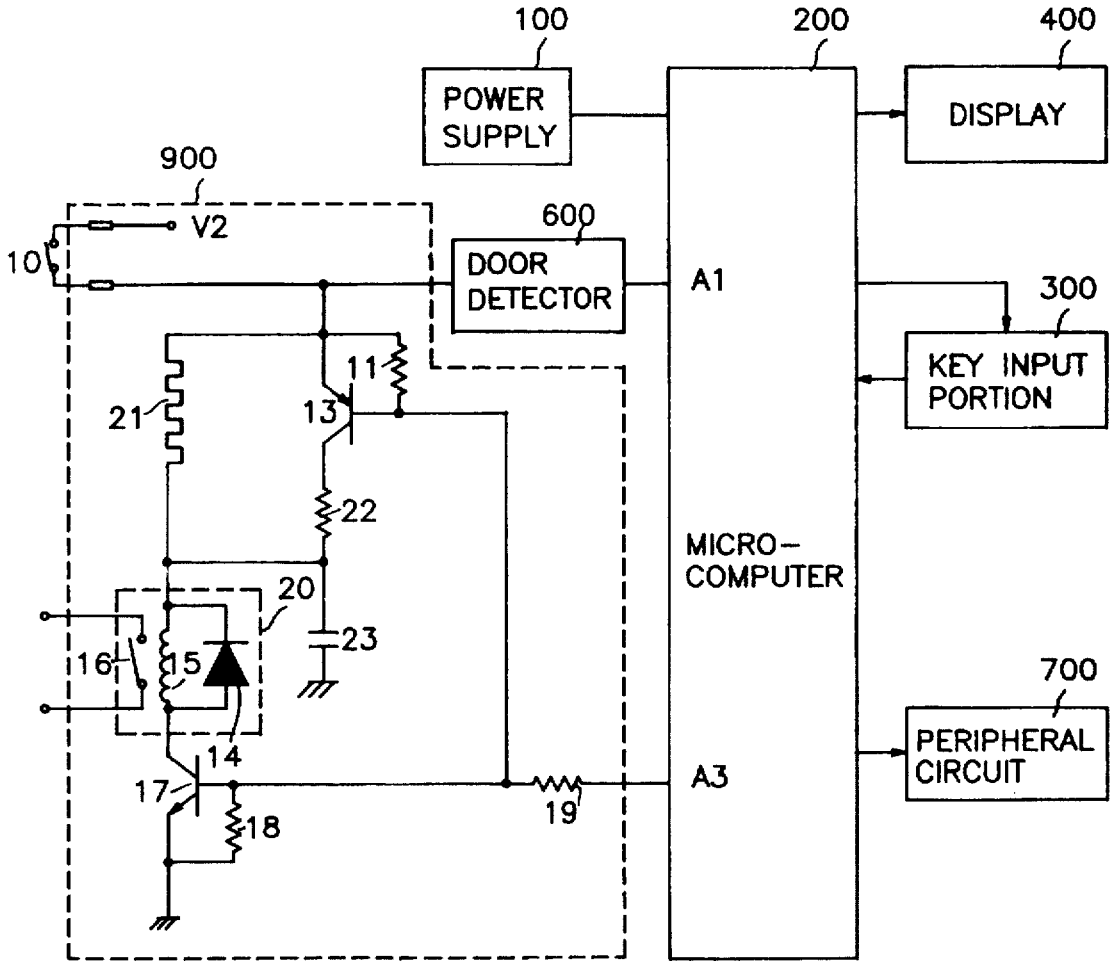
FIG. 7 is a relay driving circuit for a microwave oven according to a first embodiment of the present invention.

FIG. 7 illustrates the relay driver for a microwave oven according to an embodiment of the present invention, in which a relay driver 900 commonly connects bases of PNP transistor and NPN transistor to the output port A3 through a resistance 19 by removing the output port A2 from relay driver 800 shown in FIG. 3. The collector of PNP transistor 13 is grounded through resistance 22 and condenser 23. The contact points of resistance 22 and condenser 23 are connected to relay 20 and a damper resistance 21. Those parts which are the same as those corresponding parts in the conventional system are designated by the same reference numerals.

Figure 8:
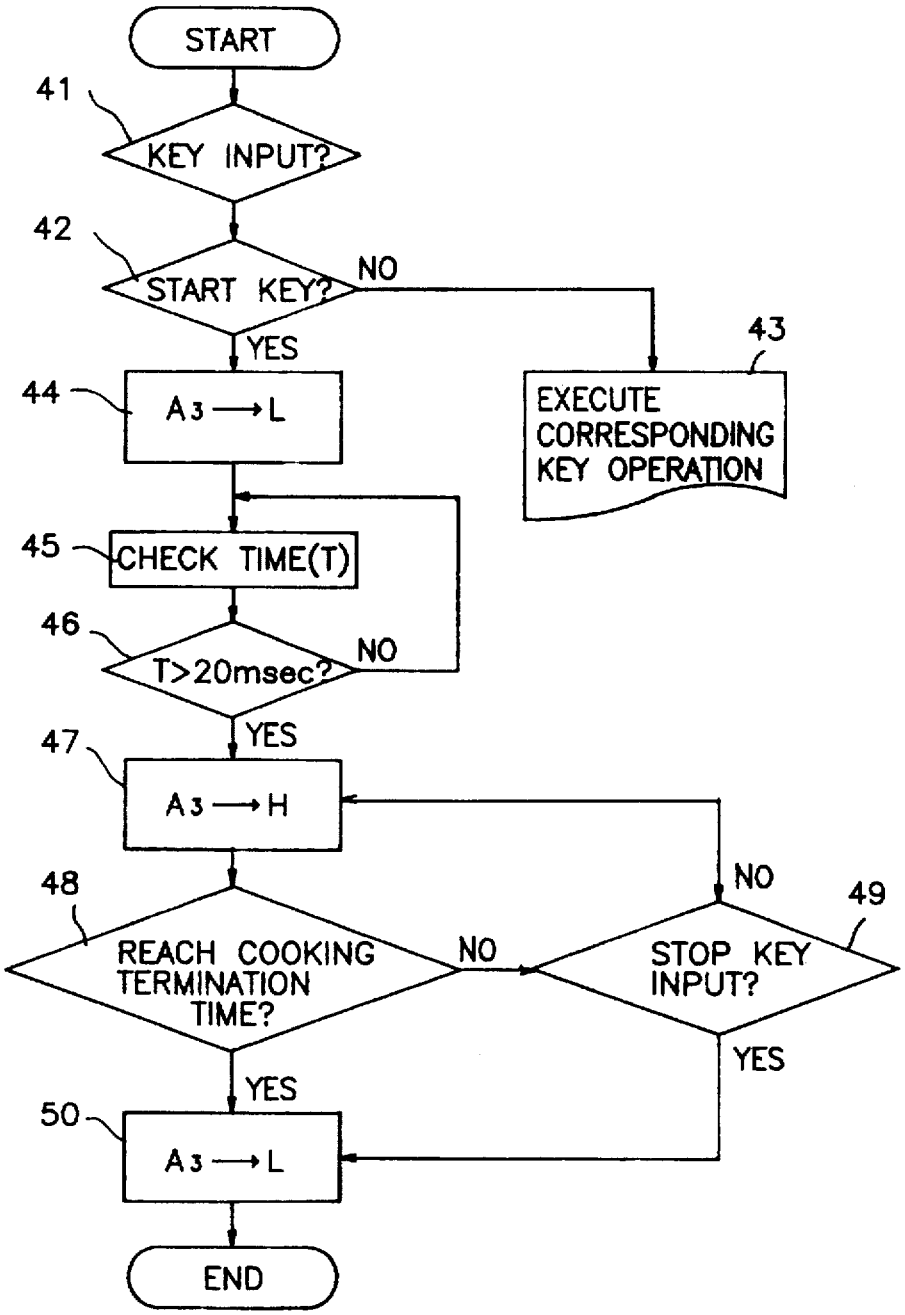
FIG. 8 is a flowchart for driving the relay in FIG. 7.

The operation of the first embodiment of the present invention will now be described with reference to FIGS. 7 and 8.

First, as shown in FIG. 7, if the user selects a predetermined cooking function through key input portion 300 and manipulates keys, microcomputer 200 recognizes a key input and determines whether or not the input key is a start key (steps 41 and 42).

At this time, if the input key is not a start key, the operation corresponding to the key (step 43). If the input key is a start key, a control signal of a low level is output via output port A3, and then time is counted (steps 44 and 45).

Therefore, PNP transistor 13 is turned on and NPN transistor 17 is turned off so that the high voltage (15V~20V) input to power supply port V2 is charged in condenser 23 via PNP transistor 13 and resistance 22.

Thereafter, microcomputer 200 counts the time. If 20 msec elapses, the control signal of a high level is output to output port A3 to turn PNP transistor 13 off but turns NPN transistor 17 on (steps 46 and 47).

Therefore, the high relay driving voltage (15V~20) charged in condenser 23 is discharged in relay coil 15 so that the contact points of relay switch 16 are coupled, thereby oscillating the magnetron to execute the cooking function.

Then, the high relay driving voltage (15V~20) discharged in condenser 23 is lowered by damper resistance 21 to maintain a normal relay driving voltage 12V so that the contact points of relay switch 16 are kept to be coupled.

In other words, the high relay driving voltage (15V~20V) is initially applied to relay 20 to reduce the operating time deviation between relay parts. If the contact points of relay switch 16 are coupled, the voltage is damped through damp resistance 21 to maintain the normal relay driving voltage (12V), thereby implementing a fix crossing.

Then, microcomputer 200 checks whether the cooling termination time is reached (step 48). If not reached, it is checked whether there is an input of a stop key or not (step 49). If there is no input of a stop key, step 47 is repeatedly performed to continuously executing the cooking function.

On the other hand, if the cooking termination time is reached or there is an input of a stop key, the control signal of a low level is output via output port A3 to stop the operation of relay 20, thereby stopping the oscillation of the magnetron to finally terminate the cooking function.

As described above, according to the present invention, a high relay driving voltage is applied at an initial relay driving time to reduce the operating time deviation between relay parts and the high relay driving voltage is lowered to a normal relay driving voltage through a damp resistance if contact points of a relay switch are coupled, thereby implementing a fix crossing. Therefore, rush current is minimized during relay operation, thereby preventing the fixation of the contact points of a relay switch and the generation of noises due to vibration.

What is claimed is:

1. A circuit for a microwave oven comprising:

a power supply for supplying power, a microprocessor for receiving the power from said power supply to execute an overall controlling operation of the circuit, a door detector for detecting a door state, a key input portion for selecting a function of said microwave oven through a user's key input portion for selecting a function of said microwave oven through a user's key manipulation, a display for displaying said selected function and the operation state of said microcomputer in accordance with the function; and a relay driving portion for reducing the operating time deviation between relay parts, the relay driving portion including a component that applies a high relay driving voltage for a predetermined time at an initial relay driving time in response to a control signal of said microcomputer and the component lowers the high relay driving voltage to a normal relay driving voltage after the initial relay driving time, the component including a damping capacitor.

2. A circuit for a microwave oven comprising:

a power supply for supplying power, a microprocessor for receiving the power from said power supply to execute an overall controlling operation of the circuit, a door detector for detecting a door state, a key input portion for selecting a function of said microwave oven through a user's key input portion for selecting a function of said microwave oven through a user's key manipulation, a display for displaying said selected function and the operation state of said microcomputer in accordance with the function; and a relay driving portion for reducing the operating time deviation between relay parts, the relay driving portion including a component that applies a high relay driving voltage for a predetermined time at an initial relay driving time in response to a control signal of said microcomputer and the component lowers the high relay driving voltage to a normal relay driving voltage after the initial relay driving time, wherein said relay driving portion includes a PNP transistor and a NPN transistor whose bases are connected to output ports of said microcomputer via resistances for respectively, a relay connected to collectors of said PNP transistor and NPN transistor for being driven in accordance with the operation state of said PNP transistor and NPN transistor, and a damper resistance connected to said PNP transistor in parallel for lowering a high voltage applied to said relay to a normal voltage.

3. A circuit for a microwave oven comprising:

a power supply for supplying power, a microprocessor for receiving the power from said power supply to execute an overall controlling operation of the circuit, a door detector for detecting a door state, a key input portion for selecting a function of said microwave oven through a user's key input portion for selecting a function of said microwave oven through a user's key manipulation, a display for displaying said selected function and the operation state of said microcomputer in accordance with the function; and a relay driving portion for reducing the operating time deviation between relay parts, the relay driving portion including a component that applies a high relay driving voltage for a predetermined time at an initial relay driving time in response to a control signal of said microcomputer and the component lowers the high relay driving voltage to a normal relay driving voltage after the initial relay driving time, wherein said relay driving portion includes a PNP transistor and a NPN transistor whose bases are connected to an output port of said microcomputer via a resistance for being operated in accordance with the control signal output from said microcomputer, respectively, a relay for being driven in accordance with the operation state of said PNP transistor and NPN transistor, a damper resistance connected to said PNP transistor in parallel for lowering a high voltage applied to said relay to a normal voltage, and a condenser connected to the collector of said PNP transistor and relay for charging/discharging a high voltage.

4. A method for driving a relay of a microwave oven, the method comprising the steps:

providing a relay switch which is coupled to a PNP transistor and to an NPN transistor and which has contact points;

connecting the contact points of the relay switch by controlling the PNP transistor and the NPN transistor to apply a high driving voltage to the relay;

controlling said PNP transistor and said NPN transistor in a manner which dampens the high driving voltage applied to said relay if a predetermined time elapses, and maintaining a normal relay driving voltage to execute a cooking function; and operating said PNP transistor and said NPN transistor in a manner which turns off said relay when a cooking termination time has been reached, to terminate the cooking function.

* * * * *